United States Patent [19]

McKee

[11] Patent Number: 4,744,476

[45] Date of Patent: May 17, 1988

[54] COLLAPSIBLE INFANT FEEDING BOTTLE

[76] Inventor: Francis X. McKee, 323 Alberts Way, Langhorne, Pa. 19047

[21] Appl. No.: 89,596

[22] Filed: Aug. 27, 1987

[51] Int. Cl.[4] ..... A61J 9/00

[52] U.S. Cl. ..... 215/11.1; 215/1 R; 206/218; 220/1 R

[58] Field of Search ..... 215/1 R, 1 C, 11.1, 215/11.6, 12.1; 150/48, 55; 206/217, 218; 229/1.5 B, 4.5, 93; 220/4 F, 1 R

[56] References Cited

U.S. PATENT DOCUMENTS

| | | | |
|---|---|---|---|
| 2,854,049 | 9/1958 | Wyllie | 150/55 |
| 2,931,409 | 4/1960 | Unthawk | 150/55 |
| 3,552,466 | 1/1971 | Fairchilds | 150/55 |
| 4,193,506 | 3/1980 | Trindle et al. | 215/11.6 |
| 4,324,340 | 4/1982 | Belokin, Jr. | 215/1 C |
| 4,572,412 | 2/1986 | Brach et al. | 215/1 C |

FOREIGN PATENT DOCUMENTS

| | | | |
|---|---|---|---|
| 593764 | 11/1953 | Canada | 215/11.1 |
| 2109247 | 6/1983 | United Kingdom | 215/11.6 |

*Primary Examiner*—David T. Fidei
*Attorney, Agent, or Firm*—Gregory J. Gore

[57] ABSTRACT

An infant feeding bottle provides a collapsible main body portion in order to prevent injury. Collapsibility is provided by elongate structures having hinge points at their ends and at their center. The elongate structures are located within the wall of the main body portion between inner and outer membranes. Both inner and outer membranes are constructed of relatively inelastic, tearable material. Under axial compression, the walls of the bottle collapse tearing both membranes and expelling any contained liquid therefrom.

6 Claims, 3 Drawing Sheets

COLLAPSIBLE INFANT FEEDING BOTTLE

FIELD OF THE INVENTION

This device relates to collapsible containers; more specifically, feeding bottles for infants.

BACKGROUND OF THE INVENTION

Product safety in the area of child care is becoming increasingly important in today's society. One area of safety that has received little attention, however, is in the area of nursing bottles. Infants are carrying or holding feeding bottles for a good part of their waking hours and the bottle may become a safety hazard in many situations.

A recent improvement has been the development of plastic infant bottles to replace glass bottles because of danger from cuts on broken glass after a bottle has shattered due to a fall. There is another aspect of bottle design, however, that has been overlooked. This is in the rigid structure of the bottle itself. In situations where the child is traveling in a vehicle while feeding from a bottle, the bottle may become a dangerous structure which can cause serious injury to the mouth and facial areas of the child in the event of a crash.

It is with the above problem in mind that the present nursing bottle has been devised to collapse upon impact and therefore help prevent injury which would otherwise be caused if the structure were rigid. Other collapsing nursing bottles have been devised. For instance, U.S. Pat. No. 2,780,378 to M. Romano discloses an accordian-like infant nursing bottle which may expand and contract. This design, however, is for adjusting to various volumes of fluid only and not for collapsing under impact for safety. If impact occurs while this accordian-like bottle is being used, the liquid sealed inside the bottle would remain contained within the bottle and therefore the structure would resist collapsing, unlike the present device.

SUMMARY OF THE INVENTION

In order to provide the necessary collapsibility, the present bottle described herein provides a novel structure which includes a burstible inner lining with a collapsible outer support structure. This permits any fluid inside the bottle to be quickly expelled permitting the outer structure to collapse freely upon impact and therefore prevent injury. Further, the present design collapses axially without volumetric reduction until the container is almost fully collapsed. This enhances the device's collapsibility.

In order to provide the greatest degree of collapsibility as described above, the present nursing bottle comprises a plurality of rod-like structures around the circumference of the nursing bottle, each of which has a central area of weakness caused by removal of material at that point. Fluid is contained within the bottle by means of an inner membrane which is affixed to the rod-like members. The inner membrane is selected to be leak-proof yet have a low resistance to tearing.

The present nursing bottle is constructed so that upon axial compression, the rod-like support members fold at the central and end hinge points and thereby tearing the attached inner membrane as they separate radially. This permits any fluid inside of the bottle to be expelled immediately at many points therefore offering little resistance to the collapsibility of the bottle structure.

Other objects and advantages of the present device will become apparent to those of skill in the art from the following drawings and continued description.

DESCRIPTION OF THE PREFERRED EMBODIMENT

Figure 1:
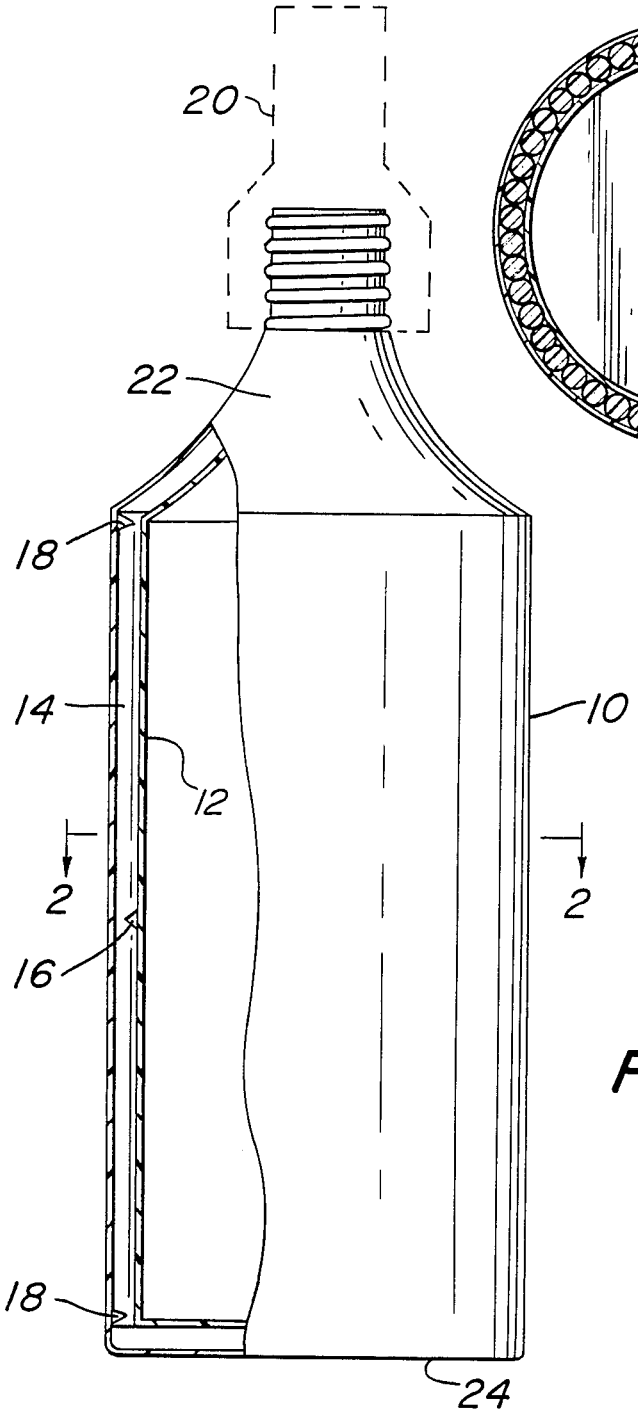
FIG. 1 is a part sectional front view.

Referring now to FIG. 1, the front view of the present nursing bottle is shown with a partial cutaway to show details of the sidewall structure. In general, the feeding bottle contains a central body with a neck portion 22 at the top, and a cylindrical base 24 at the bottom. A cap 20 shown in phantom lines at the top completes the bottle structure.

The main body of the bottle is constructed primarily of three elements; an inner membrane 12, an outer membrane 10, and a plurality of substantially cylindrical rods 14 which are affixed to and thereby support membranes 10 and 12. The rods 14 contain a central point 16 which is notched in the radial direction; that is, material is removed creating a V-shaped detent pointed toward the outer circumference of the body of the bottle. This detent 16 in the center of the rod is complimented by detents 18 at either end of each rod. Detents 18 and 16 permit the rods to buckle at these points of weakness and provide the collapsibility of the present device.

Figure 2:
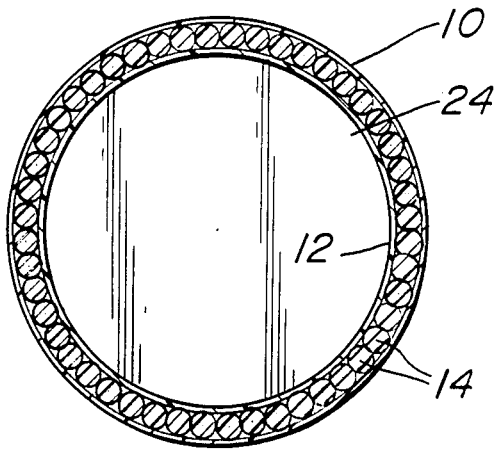
FIG. 2 is a sectional view taken from FIG. 1.

FIG. 2 is a sectional view of FIG. 1 showing the location of each of the rods 14 and the location of the inner and outer membranes.

Figure 3:
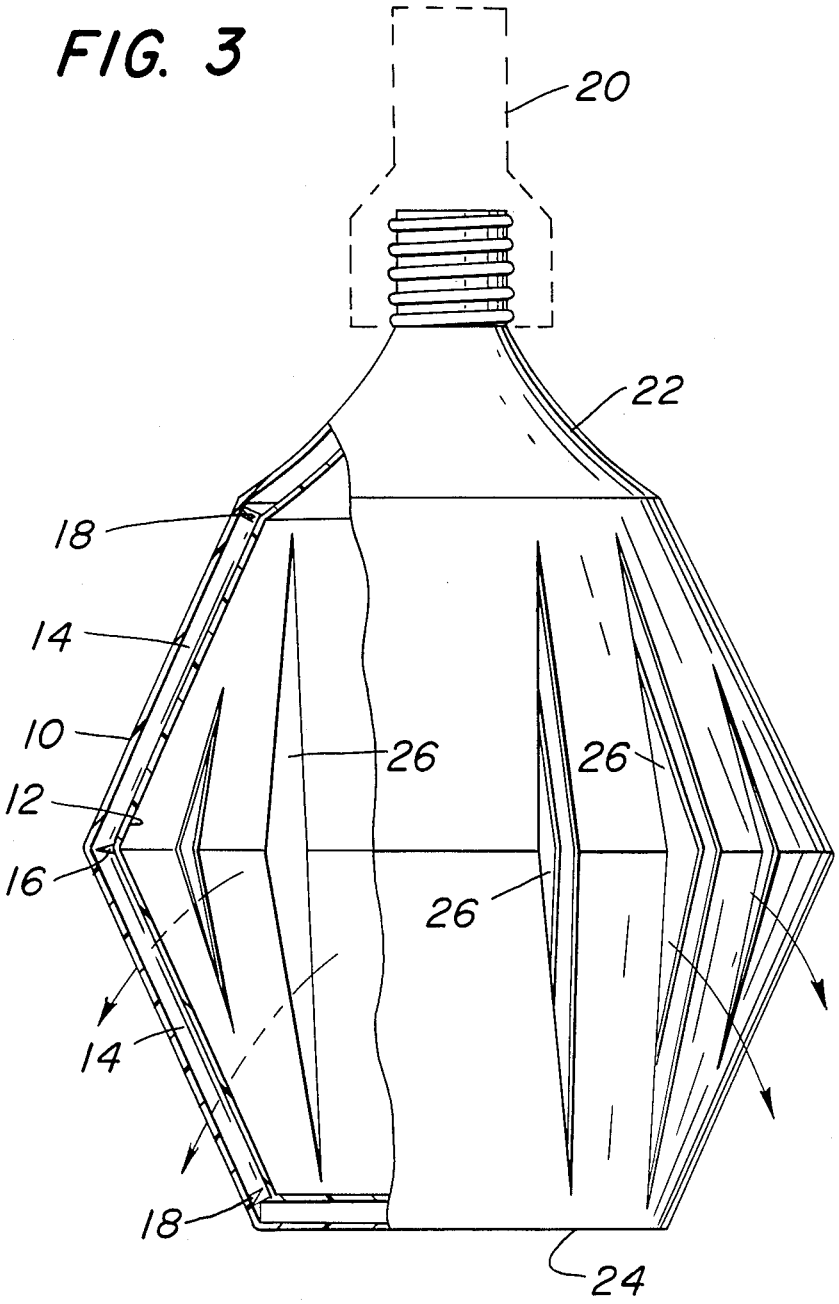
FIG. 3 is a front view showing the present device in a partially collapsed state.

FIG. 3 shows the present device in a partially collapsed state. As shown in this figure, detents 16 and 18 are partially closed due to the angulation of the upper and lower portions of each rod 14 which remain substantially straight. As the bottle collapses, diamond-shaped tears 26 form in both inner and outer membranes as the rods spread and separate at the midpoint at the level of detent 16 which spreads radially. The arrows in FIG. 3 indicate liquid being expelled from the bottle. It is important to note that upon initial axial compression, the volume of the bottle actually increases and therefore there is very little resistance force due to the compression of the liquid which is permitted to flow freely through the tears 26. Neck portion 22 and cylindrical base 24 retain their structural integrity during axial compression.

Figure 4:
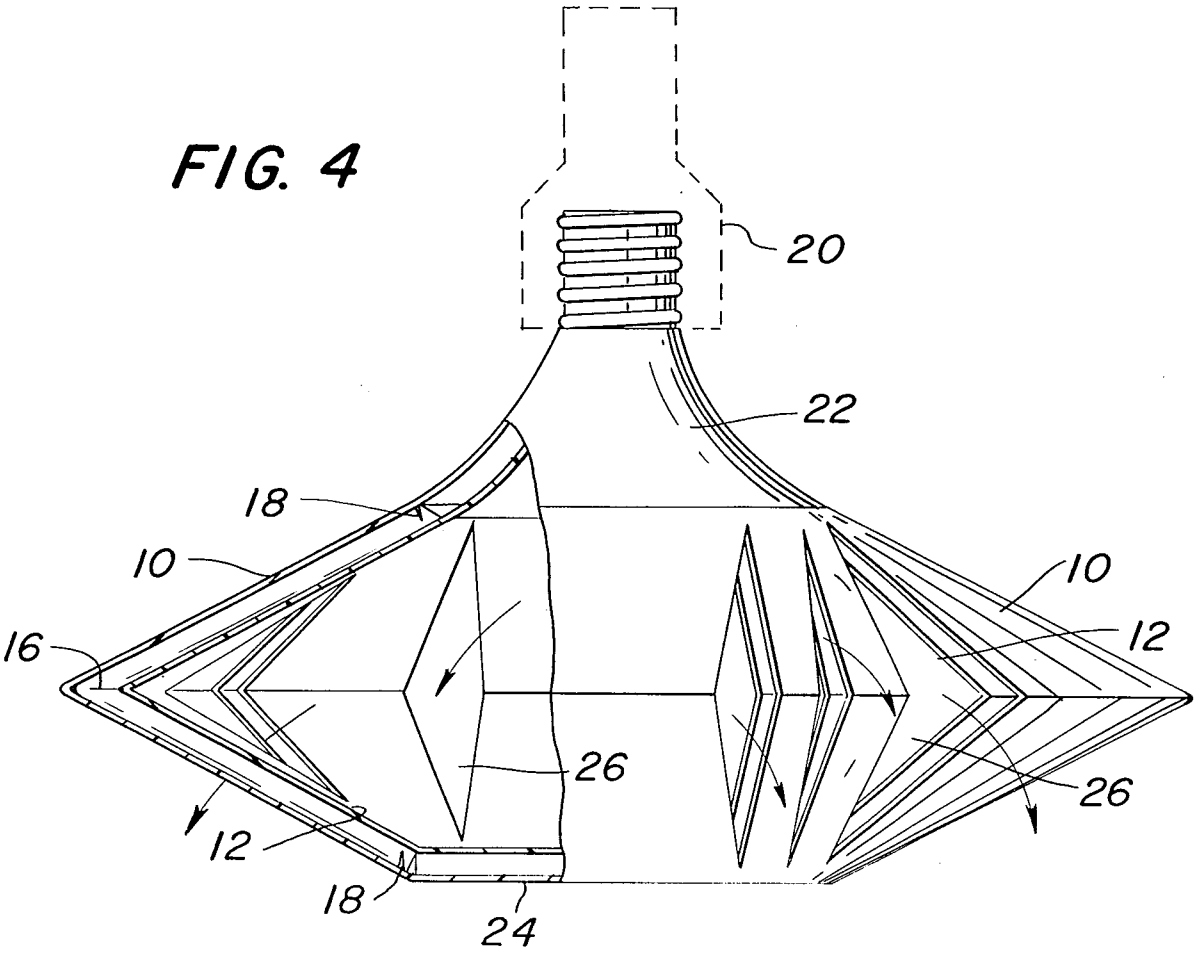
FIG. 4 shows the present device fully collapsed.

FIG. 4 shows the bottle of FIG. 3 in its final state of compression in which the volume of the area inside the inner membrane becomes substantially reduced and fluid inside the bottle depicted by the arrows is squirted out the tears 26. Detents 18 and 16 are almost fully closed due to the hinge-like action of the rods at these points. Membranes 10 and 12 are preferably made from a thin thermoplastic material which is liquid-tight, yet which is substantially rigid so that it will shear under tension. Any other material of choice is adequate so long as it meets these requirements.

It should be understood that the above description discloses specific embodiments of the present invention and are for purposes of illustration only. There may be other modifications and changes obvious to those of ordinary skill in the art which fall within the scope of the present invention which should be limited only by the following claims and their legal equivalents.

What is claimed is:

1. A container, comprising;

a. a cylindrical main body portion including a tapered neck at the top and a circular base at the bottom, b. a tearable outer membrane enclosing the entire periphery of said cylindrical main body portion, c. a tearable inner membrane concentric with and located within said outer membrane, d. a plurality of axially oriented rod-like members between said inner and said outer membranes affixed thereto, and e. a plurality of hinge points located in the middle and at the ends of said rod-like members whereby under axial compression, said container will collapse tearing said inner and outer membranes and expelling any fluid contained therein.

2. The container of claim 1 further described in that said rod-like members extend the entire axial length of said cylindrical body portion.

3. The container of claim 2 further described in that each rod-like member contains a hinge point at approximately the midpoint along the length of said rod-like member.

4. The container of claim 3 wherein said hinge points are created by the removal of material creating a detent in said rod-like members.

5. The container of claim 4 wherein said detents are V-shaped and converge radially whereby upon axial compression two adjacent rod-like members diverge radially and are forced apart at their midpoint.

6. The container of claim 5 wherein said container is an infant feeding bottle.

* * * * *